United States Patent [19]

Kowal et al.

[11] Patent Number: 4,590,899

[45] Date of Patent: May 27, 1986

[54] SELF-CONTAINED LASH ADJUSTER WITH SHELL MOUNTED CARTRIDGE ASSEMBLY

[75] Inventors: Steven J. Kowal, Prospect Heights; Kenneth W. Lesher, Wheaton, both of Ill.

[73] Assignee: Stanadyne, Inc., Windsor, Conn.

[21] Appl. No.: 735,202

[22] Filed: May 17, 1985

[51] Int. Cl.[4] ..... F01L 1/24

[52] U.S. Cl. ..... 123/90.58; 123/90.55

[58] Field of Search ..... 123/90.55, 90.56, 90.57, 123/90.58, 90.59

[56] References Cited

U.S. PATENT DOCUMENTS

| | | | |
|---|---|---|---|
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 3,521,608 | 7/1970 | Scheibe | 123/90.58 |
| 4,397,271 | 8/1983 | Gardner | 123/90.58 |

FOREIGN PATENT DOCUMENTS

| | | | |
|---|---|---|---|
| 146210 | 11/1980 | Japan | 123/90.58 |
| 160106 | 12/1980 | Japan | 123/90.58 |
| 2089923 | 6/1982 | United Kingdom | 123/90.55 |

*Primary Examiner*—Ira S. Lazarus

*Attorney, Agent, or Firm*—Kinzer, Plyer, Dorn & McEachran

[57] ABSTRACT

A self-contained lash adjuster includes a generally cylindrical cup-shaped follower which has an end face. A lash adjuster cartridge assembly is positioned within the follower. The cartridge assembly includes a reciprocally movable body and a plunger within the body. There is a high pressure chamber defined between the plunger and the body and a plunger passage opens into the high pressure chamber. A check valve controls fluid flow through the plunger passage. A shell holds the cartridge assembly to the follower and has an annular wall extending peripherally about the movable body of the cartridge assembly. There is an annular expandable seal member fastened at one end to the shell and at the other end to the body to define a reservoir outside of the cartridge assembly. Movement of the body toward the plunger moves fluid from the high pressure chamber to the reservoir.

10 Claims, 2 Drawing Figures

SELF-CONTAINED LASH ADJUSTER WITH SHELL MOUNTED CARTRIDGE ASSEMBLY

SUMMARY OF THE INVENTION

The present invention relates to self-contained hydraulic lash adjusters and in particular to a self-contained lash adjuster which is mounted within a shell attached to the lash adjuster follower and in which there is a peripheral seal forming a closed reservoir about the exterior of the lash adjuster cartridge assembly.

A primary purpose of the invention is a hydraulic lash adjuster using a cartridge assembly consisting of a body and a plunger and in which a seal exterior of the body provides a self-contained reservoir for hydraulic fluid.

Another purpose is a lash adjuster of the type described in which the seal is expandable to receive excess fluid from the low pressure chamber.

Another purpose is a simply constructed, reliably operable self-contained hydraulic lash adjuster of the type described.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

U.S. Pat. No. 4,397,271, assigned to the assignee of the present application, shows a semi-self-contained hydraulic lash adjuster using a diaphragm seal. The present invention uses a flexible seal in a self-contained lash adjuster in which the seal defines a fluid reservoir in communication with the lash adjuster low pressure chamber. The seal is fixed to the movable body forming one element of the lash adjuster cartridge assembly and to the shell which mounts the cartridge assembly within the follower. The seal expands and contracts during operation of the lash adjuster as fluid is moved between the high pressure chamber and the reservoir during normal engine operation.

One of the advantages of a self-contained lash adjuster is that it prevents aerated oil reaching the high pressure chamber in the adjuster, thus reducing the possibility of a noisy tappet or lash adjuster. However, in such a self-contained lash adjuster, it is necessary that the reservoir of hydraulic fluid be permanently and satisfactorily sealed so as to prevent loss of fluid. The present invention provides an improved type of seal which is firmly attached at its opposite ends to the lash adjuster cartridge assembly and to the shell which mounts the cartridge assembly so that the fluid reservoir maintains its integrity over the long period of time and long mileage requirements placed on lash adjusters in state-of-the-art engines.

The lash adjuster will be positioned axially above the engine valve and immediately below an overhead cam. The lash adjuster disclosed herein is specifically designed for use in small efficient internal combustion engines utilizing overhead cams.

Figure 1:
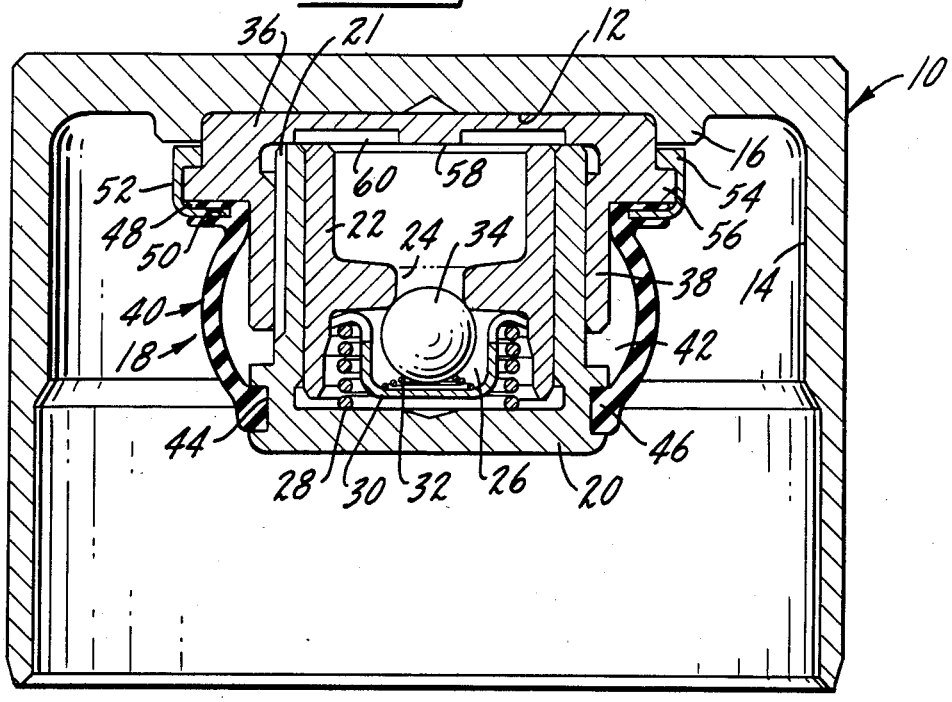
FIG. 1 is an axial section through one embodiment of the invention.

In FIG. 1, a follower is indicated generally at 10 and is of a cup-shaped configuration and has an interior end face 12 and an interior cylindrical wall 14. An annular wall 16 extends axially away from end face 12 to mount a cartridge assembly indicated generally at 18.

The cartridge assembly 18 includes a body 20 reciprocally movable relative to an interior plunger 22. Plunger 22 has a passage 24 which connects to a high pressure chamber 26. A coil spring 28 normally biases the plunger and body in opposite directions and supports a retainer 30 which positions a small coil spring 32 urging a check valve in the shape of a ball 34 toward a position closing passage 24.

The cartridge assembly is mounted within the follower by means of a shell 36 which is closely fitted within wall 16 of the follower. Shell 36 has an axially extending wall 38 which closely fits about body 20 and provides for reciprocal movement of the body. Body 20 includes a passage 21 to allow unrestricted flow of the fluid between the plunger low pressure cavity and seal cavity 42.

A cylindrically-shaped seal 40 is positioned exteriorly of the cartridge assembly to define a fluid reservoir 42. The seal is attached at its opposite ends to the body and the shell. There is an annular groove 44 adjacent the face of the body remote from end face 12 and seal 40 has an enlarged area 46 which is positioned within groove 44 to thereby secure one end of the seal to the body. At the opposite end of seal 40 there is a flange 48 having a small groove 50 which receives one end of a retaining ring 52. The opposite end of retaining ring 52 has an inwardly-directed flange 54 which fits over an outwardly extending annular projection 56 of shell 38. Thus, retaining ring 52 secures the opposite end of seal 40 to the shell to complete the definition of the reservoir which is formed outside of the cartridge assembly and its mounting shell.

The interior face 58 of shell 38 may have a plurality of radially extending grooves 60 which form passages connecting the interior of plunger 22 with the exterior of the plunger. Body 20 may include a plurality of grooves or a spiral groove to define passage 21 to allow unrestricted fluid flow. Thus, when the body reciprocally moves during normal engine operation, hydraulic fluid within the high pressure chamber can pass through passages 60 to reach the exterior of the plunger. It will then pass through passage 21 in the body into reservoir 42. When the body is in the bottomed position shown, the high pressure chamber is reduced in size and fluid from the chamber will be in the reservoir, causing an expansion of seal 40. When the body moves to an extended position, the fluid will be removed from the reservoir through passage 21, passages 60, passage 24 and back into the high pressure chamber. Thus, seal 40 must be formed of a material which is expandable in order to accomodate the transfer of fluid from the high pressure chamber to the reservoir. The material also must have sufficient resiliency to urge the fluid from the reservoir back through the path described to the high pressure chamber. In addition, the chemical characteristics of the seal are important, as the seal must be resistant to the silicon components normally found in hydraulic fluids. A material sold under the trademark VAMAC has been found to be satisfactory.

Figure 2:
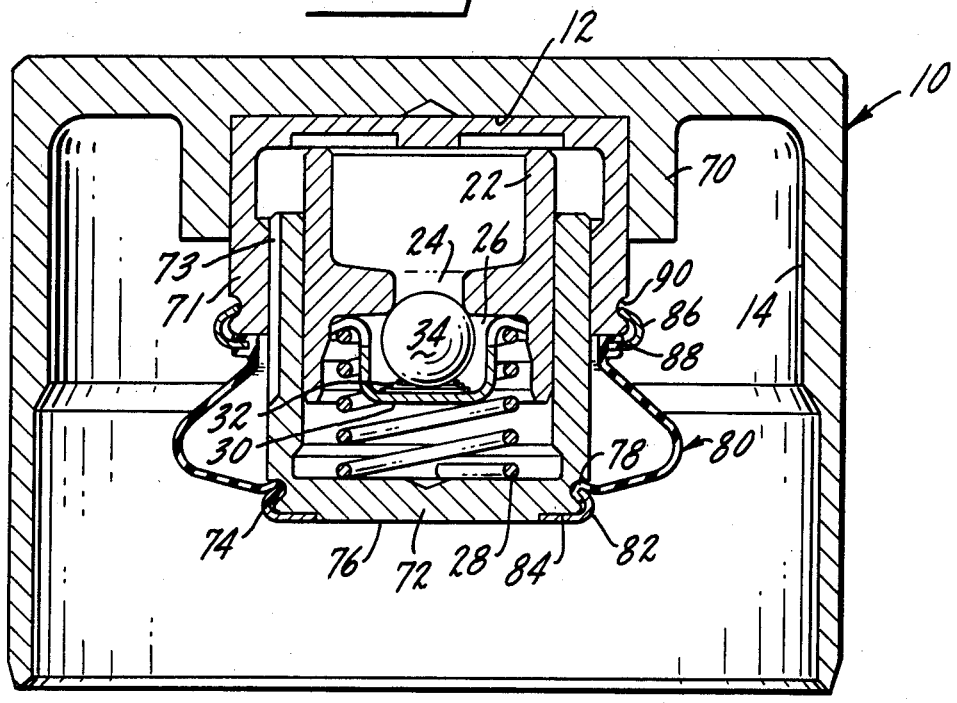
FIG. 2 is an axial section, similar to FIG. 1, but showing a modification of the lash adjuster of FIG. 1.

In the FIG. 2 embodiment, like parts have been given the same number. In this case, the body is shown in the extended position rather than the non-extended or bottomed position of FIG. 1. In FIG. 2 a wall 70 extends outwardly from end face 12 of the follower and it should be noted that the length of the wall is substantially greater than that illustrated in FIG. 1, thus providing additional support for the shell 71 and its cartridge assembly. The body of the cartridge assembly is indicated at 72 and has a small recess 74 adjacent its end face 76. There is an axial passage 73 in body 72. The recess 74 is used to accommodate an end 78 of seal 80 with attachment being brought about by a fastening ring 82 which extends into the end of the seal and about the end of body 72. There is a small groove 84 in the end surface 76 of the body to accommodate fastening ring 82.

The opposite end of seal 80 is fastened by a retaining ring 86 which extends into a groove 88 in the end of the seal and into a small recess 90 at the end of the shell most remote from end face 12 of the follower.

The principal differences between the FIGS. 1 and 2 embodiments are that in the FIG. 2 embodiment, wall 70 provides greater support for the shell and the mass of the seal is reduced as it is only fastened to the end of the shell rather than to that part of the shell closely adjacent the follower end face 12. The operation of the FIG. 1 and 2 embodiments is the same.

Whereas the preferred form of the invention has been shown and described herein, it should be realized that there may be many modifications, substitutions and alterations thereto.

The embodiments of the invention in which an exclusive property or privilege is claimed are defined as follows:

1. A self-contained lash adjuster including a generally cylindrical cup-shaped follower having an end face, a lash adjuster cartridge assembly within said follower, said cartridge assembly including a reciprocally movable body and a plunger within said body, a high pressure chamber between said plunger and body, a plunger passage opening into said high pressure chamber, a check valve controlling fluid flow through said plunger passage, a shell holding said cartridge assembly and having an annular wall extending peripherally exteriorly of said movable body, said shell being mounted to said follower end face, and an annular expandable seal member extending about said shell and cartridge assembly and fastened at one end to said shell and at the other end to said body to define a reservoir exterior of said cartridge assembly, movement of said body toward the plunger moving fluid from the high pressure chamber to said reservoir.

2. The lash adjuster of claim 1 further characterized by and including an annular wall extending outwardly from said follower end face, said shell being positioned within said annular wall to fasten the shell to the follower.

3. The lash adjuster of claim 1 further characterized in that said seal is fastened to the end of said cartridge assembly body most remote from said follower end face.

4. The lash adjuster of claim 3 further characterized by and including an annular groove adjacent the end of said cartridge assembly body remote from said follower end face, said seal having an enlarged area positioned within said groove to thereby fasten said seal to said body.

5. The lash adjuster of claim 4 further characterized by and including a retaining ring fastening said one end of said seal to said shell.

6. The lash adjuster of claim 5 further characterized by and including an annular flange extending outwardly from said shell, said retaining ring being fastened about said annular flange to secure said one end of said seal to said shell.

7. The lash adjuster of claim 6 further characterized in that said shell flange is closely adjacent the end face of said follower.

8. The lash adjuster of claim 3 further characterized by and including a fastening ring attaching said other end of said seal to said body.

9. The lash adjuster of claim 8 further characterized by and including a retaining ring fastening said one end of said seal to said shell generally adjacent the end of said shell remote from said follower end face.

10. The lash adjuster of claim 9 further characterized in that said end face wall extends a substantial distance away from said end face and along the cylindrical exterior of said shell.

* * * * *